US009000999B2

(12) United States Patent
Venghaus et al.

(10) Patent No.: US 9,000,999 B2
(45) Date of Patent: Apr. 7, 2015

(54) ENCLOSURE SYSTEM FOR AN ANTENNA

(71) Applicant: Winegard Company, Burlington, IA (US)

(72) Inventors: Brent Lee Venghaus, Mount Pleasant, IA (US); Orrin Ryan Lanz, Wapello, IA (US)

(73) Assignee: Winegard Company, Burlington, IA (US)

( * ) Notice: Subject to any disclaimer, the term of this patent is extended or adjusted under 35 U.S.C. 154(b) by 290 days.

(21) Appl. No.: 13/762,000

(22) Filed: Feb. 7, 2013

(65) Prior Publication Data

US 2013/0207868 A1 Aug. 15, 2013

Related U.S. Application Data

(60) Provisional application No. 61/597,147, filed on Feb. 9, 2012.

(51) Int. Cl.
*H01Q 19/12* (2006.01)
*H01Q 1/42* (2006.01)

(52) U.S. Cl.
CPC . *H01Q 19/12* (2013.01); *H01Q 1/42* (2013.01)

(58) Field of Classification Search
CPC ..... H01Q 1/42; H01Q 1/428; H01Q 19/10; H01Q 19/12
USPC ..... 343/872, 882
See application file for complete search history.

(56) References Cited

U.S. PATENT DOCUMENTS

| | | | | |
|---|---|---|---|---|
| 4,628,323 | A | 12/1986 | Crean | |
| 4,825,218 | A | 4/1989 | Begout | |
| 7,050,012 | B2 | 5/2006 | Chen | |
| 7,113,144 | B2 | 9/2006 | Lin | |
| 7,142,168 | B1 | 11/2006 | Sinclair | |
| 7,679,573 | B2 * | 3/2010 | Shuster et al. | 343/766 |
| 2011/0006965 | A1 * | 1/2011 | Kits van Heyningen | 343/841 |
| 2011/0267255 | A1 * | 11/2011 | Locatori | 343/872 |

* cited by examiner

*Primary Examiner* — Robert Karacsony
(74) *Attorney, Agent, or Firm* — W. Scott Carson

(57) ABSTRACT

An enclosure system for antennas including satellite dish antennas and single frequency, narrowband and broadband ones. The system includes at least upper and lower housing portions mounted to each other for rotational movement about a first axis inclined to the vertical. The portions have respective, peripheral sections extending about the first axis and substantially perpendicular to the inclined, first axis. The satellite antenna dish is mounted to the upper housing portion to extend substantially about a second axis substantially intersecting the first axis at an inclined angle. The upper housing portion can be rotated about the inclined, first axis relative to the lower housing portion wherein the second axis of the dish essentially forms or defines a cone about the first axis to position the plane of the dish rim portion in any of a plurality of orientations essentially between a substantially horizontal one and a substantially vertical one.

24 Claims, 10 Drawing Sheets

Key $\theta_1$ = Azimuth Housing angle $\theta_2$ = Elevation Housing angle $\theta$ = Look Angle $\theta_{high}$ is the maximum look angle $\theta_{low}$ is the minimum look angle Equations $$\theta_{high} = 90^o + \theta_2 - \theta_1$$

$$\theta_{low} = 90^o - \theta_2 - \theta_1$$

Solved $$\theta_1 = \frac{(\theta_{high} + \theta_{low}) - 180^o}{-2}$$

$$\theta_2 = 90^o - \theta_{low} - \theta_1$$

Key $\theta_1$ = Lower Housing angle $\theta_2$ = Upper Housing angle $\theta$ = Look Angle $\theta_{high}$ is the maximum look angle $\theta_{low}$ is the minimum look angle Equations $$\theta_{high} = 90^o + \theta_2 - \theta_1$$

$$\theta_{low} = 90^o - \theta_2 - \theta_1$$

Solved $$\theta_1 = \frac{(\theta_{high} + \theta_{low}) - 180^o}{-2}$$

$$\theta_2 = 90^o - \theta_{low} - \theta_1$$

ENCLOSURE SYSTEM FOR AN ANTENNA

RELATED APPLICATIONS

This application claims the benefit of U.S. Provisional Patent Application Ser. No. 61/597,147 filed Feb. 9, 2012, which is incorporated herein by reference.

BACKGROUND OF THE INVENTION

1. Field of the Invention

This invention relates to the field of enclosure systems for antennas including satellite dish, single frequency, narrowband frequency, and broadband frequency ones.

2. Discussion of the Background

Enclosure systems for antennas have been designed that offer a wide variety of advantages and disadvantages. For satellite dish antennas in particular, systems with radomes are a well known option that cover or enclose the dish and its components (e.g., amplifier and motorized drive). In doing so, radomes offer the distinct, cost-saving advantage that less expensive and lower performing components can be used because the antenna and its components are protected from the elements under the radome. As for example and since the electronics of the system are not exposed to outside elements, they do not necessarily need to have weatherproof housings. Additionally, since the dish or reflector is enclosed and not exposed to high wind conditions, it does not have to be made of the more expensive and rigid materials typically required for uncovered dishes.

A disadvantage of enclosure systems with radomes is that the height of the radome is essentially a function of the size of the dish or reflector. That is, when the system is not in operation, the radome height still remains the same since it houses the dish or reflector. The radome height in most designs must then generally be as high or higher than the maximum dimension of the dish, which is typically the diameter of its rim. This high profile can present problems for example if the enclosure system with the radome is mounted on a recreational or similar vehicle and the vehicle is to be stored in a garage or under a protective structure with a height restriction. Similarly, the high profile can present height problems for storage even if the enclosure system with the radome is removable from the vehicle or is intended for use as a standalone unit since it may still be too high to be stored on a convenient shelf or under the vehicle. So called popup units that have the dish or reflector located outside of a protective housing can normally be stowed or stored in a lower height configuration than an enclosure system with a radome. However, they usually require that the exposed dish and any exposed components be made of more expensive and rigid materials as well as weatherproofed. Such units are also much less suited to mobile tracking applications because the dish or reflector is exposed to wind resistance With this and other problems in mind, the present invention was developed. In it, a basic enclosure system is provided for satellite dish antennas and other antennas including single frequency, narrowband frequency, and broadband frequency ones that can assume a stored position shorter than the maximum dimension of the dish or other antenna. In the preferred embodiment, the dish or other antenna is covered or enclosed and is designed to actually become part of the protective housing or enclosure and to move with it. In the embodiments designed for housing or enclosing a satellite dish antenna, the invention combines or integrates the protective advantages of an enclosure system with a radome with the alignment advantages of a polar arrangement to create a superior product.

SUMMARY OF THE INVENTION

This invention involves an enclosure system for antennas including satellite dish antennas, single frequency, narrowband frequency, and broadband frequency ones. With satellite dish antennas, the system includes at least upper and lower housing portions that are mounted to each other for rotational movement about a first axis inclined to the vertical. In one embodiment, the upper and lower housing portions have respective, substantially circular peripheral sections extending about the first axis and abutting one another. The sections extend substantially parallel to each other and to a plane that is substantially perpendicular to the inclined, first axis. The satellite antenna has a dish-shaped reflector and is mounted to the upper housing portion to extend substantially about a second axis that substantially intersects the first axis at an inclined angle. The dish-shaped reflector has a substantially circular, rim portion extending about the second axis substantially in a plane that is essentially perpendicular to the second axis.

In this embodiment, the upper housing portion can be rotated about the inclined, first axis relative to the lower housing portion wherein the second axis essentially forms or defines a cone about the first axis. In doing so, the plane of the rim portion of the dish-shaped reflector can be positioned as desired in any of a plurality of orientations essentially between a substantially horizontal one and a substantially vertical one. In particular and with the first axis inclined at 45 degrees to the vertical, the plane of the rim portion can be moved to either a horizontal or vertical orientation and any orientation therebetween. In a design chosen for reception in the United States, the first axis could be customized to be inclined at 37.5 degrees to the vertical wherein the plane of the rim portion of the dish-shaped reflector is then movable from the extremes of horizontal and 15 degrees elevation and any orientations in between. In particular and as used herein, any reference to the plane of the rim portion or any other plane as being positionable substantially or nearly vertically is meant to include such a customized variation. The lower housing portion and its supporting base could also be marked for proper azimuth orientation during installation or motorized if desired. Similarly, the adjacent peripheral sections of the upper and lower housing portions can be so marked for elevation and skew.

In the embodiments for a satellite dish antenna, the rim portion of the dish-shaped reflector is preferably covered and the covered reflector becomes part of the protective housing or enclosure. As compared to a typical radome design in which the entire dome of the radome must be made of expensive, radio frequency (RF) permeable material, only the cover over or across the rim portion of the dish-shaped reflector must then be made of such material. This is the case because in the present design, the dish-shaped reflector is fixed to and moves with the housing or enclosure in contrast to the typical radome design in which the dish-shaped reflector moves within and relative to the radome. The present design greatly reduces the cost of the system and even offers the user the option of making the cover out of more expensive and superior RF permeable material at less than or at least no additional, overall cost beyond a typical radome design made entirely of an inferior RF permeable material. That is, the cover can be made of the more expensive, better performing material and the rest of the housing of a much cheaper material as the dish-shaped reflector only receives signals through the cover and no other part of the protective housing as is the case in a typical radome. The result can be not only is a better performing antenna but also a less expensive one. Additionally, the design of the present invention with or without the cover also allows the rest of the enclosure to be made out of non-radio frequency permeable material or materials if desired that would be tailored to a specific application such as ultraviolet (UV) or heat resistance.

Another major advantage of the present design as it is applied to house or enclose a satellite dish antenna is that the dish-shaped reflector can be easily skewed manually in comparison to a typical radome design. This is the case whether or not a protective cover is provided over or across the rim portion of the reflector. That is, common radome designs require that the entire dome be removed to manually skew the antenna whereas the design of the present invention only requires that the protective cover be removed (if one is used). Otherwise, the antenna can be manually skewed directly if no protective cover is provided. The same is true for making other, common adjustments.

Other advantages of the present invention are also provided. As for example and since the protective housing or enclosure can assume a storage position that is shorter than the maximum height of the antenna element (be it a dish-shaped reflector or other antenna), a larger antenna can be used than in a typical radome design in which the storage height is as high or higher than the maximum dimension of the antenna. Being able to use a larger antenna (e.g., larger diameter reflector) can then offer a higher gain for better reception. The present design also allows for a large, interior space or volume for more electronics and devices (e.g., rotors, amplifiers, wireless transmitters, motors, and additional antennas) if desired.

In the embodiments for a satellite dish antenna, the dish-shaped reflector can be recessed into the housing and covered or not covered as discussed above. It could also be fixed to the outside of the housing if desired and the same is true for other antennas such as single frequency, narrowband frequency, and broadband frequency ones. That is, the basic design of the housing can be used as an adjustable mount with the antenna either mounted inside the housing or to its exterior. The basic design of the housing also permits it to be mounted on sloped surfaces such as a roof with the inclined angle of the upper and lower housing portions modified accordingly or an additional, tilt adjustment member could be provided. Further, in instances where height is not critical, the housing can be made more aerodynamic by capping the reflector with an arched cover. This would give the housing an overall spherical or other aesthetic and aerodynamic shape more suitable for marine and vehicle tracking applications.

DETAILED DESCRIPTION OF THE INVENTION

Figure 1A:
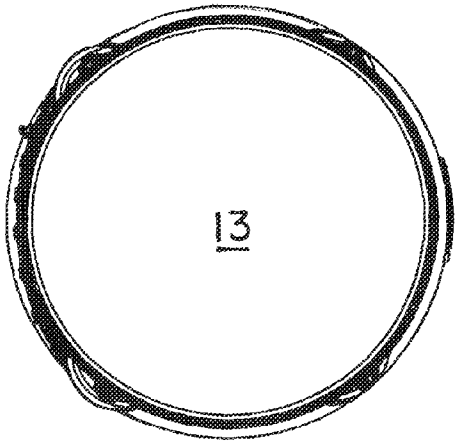
FIGS. 1*a*-1*d* are a series of views of one embodiment of the enclosure system of the present invention with the upper or elevation housing portion rotated relative to the lower or azimuth housing portion to orient the planar section of the upper housing portion substantially horizontally. In doing so, the antenna element within the upper housing (e.g., a dish-shaped reflector) is pointed upwardly at substantially 90 degrees to the horizontal.
Figure 1C:
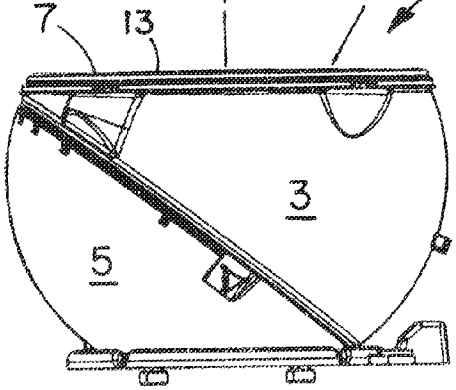
Figure 1D:
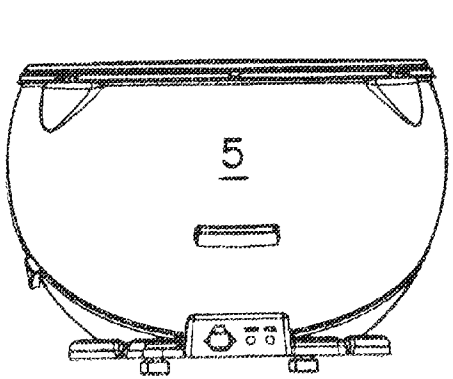
Figure 1B:
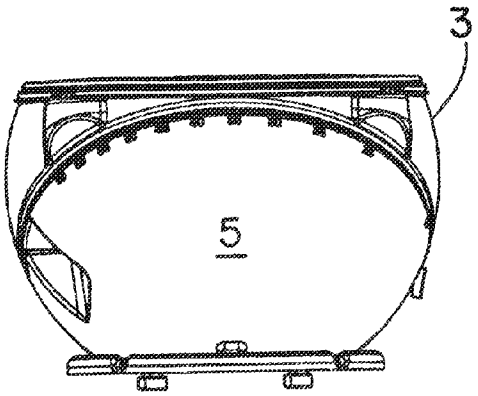
Figure 2A:
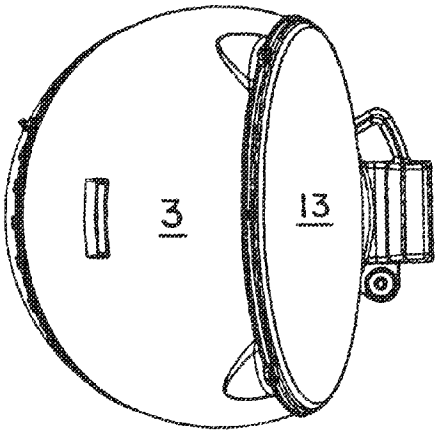
FIGS. 2*a*-2*d* are a similar series of views of the enclosure system of FIG. 1 with the upper housing portion rotated relative to the lower housing portion to the other extreme with the planar section of the upper housing portion nearly vertical.
Figure 2C:
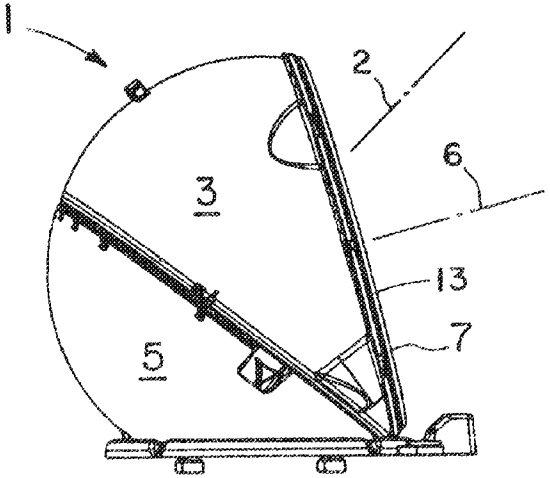
Figure 2D:
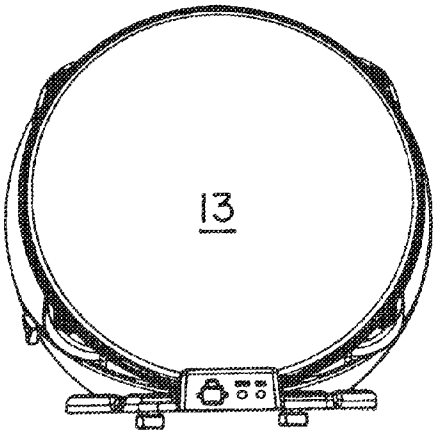
Figure 2B:
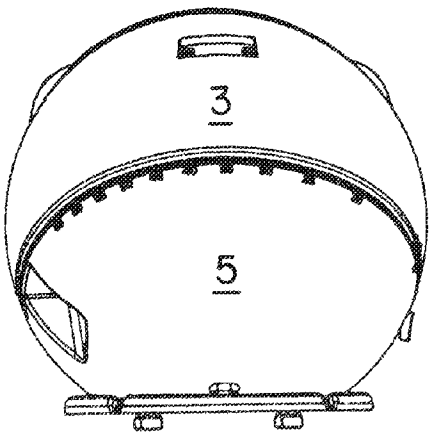
Figure 3A:
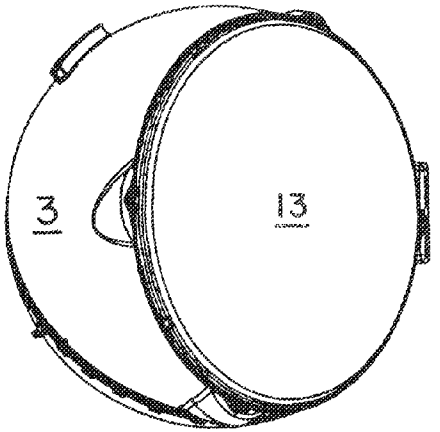
FIGS. 3*a*-3*e* are a further series of views of the enclosure system with the upper housing portion rotated relative to the lower housing portion to a position between the extremes of FIGS. 1*a*-1*d* and 2*a*-2*d*.
Figure 3B:
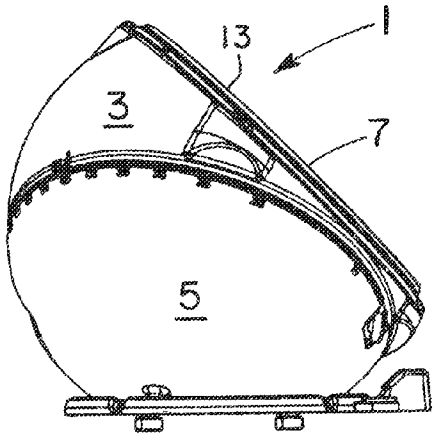
Figure 3C:
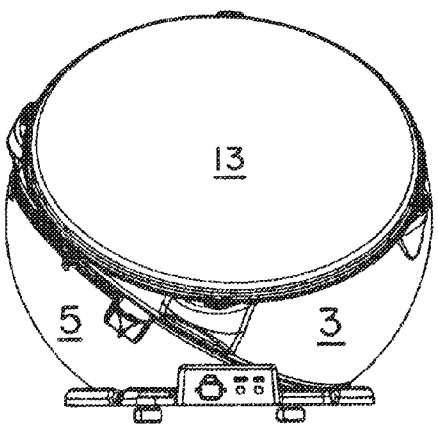
Figure 3D:
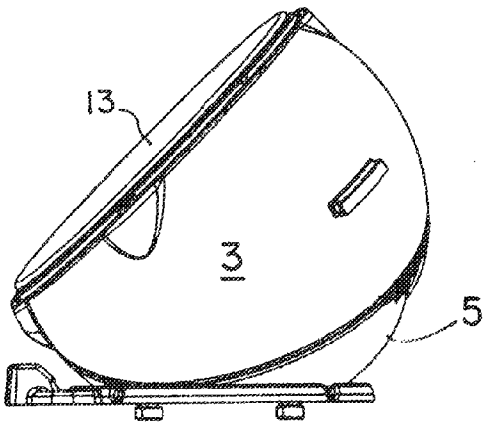
Figure 3E:
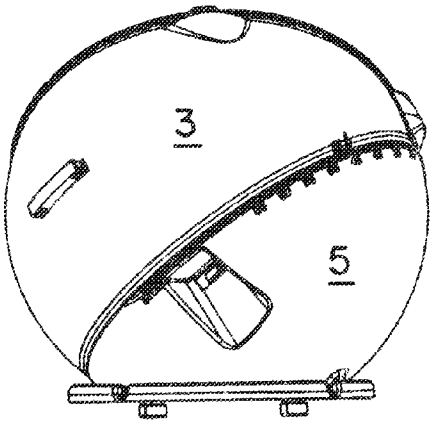

As shown in the series of views of FIGS. 1*a*-1*d*, the enclosure system 1 of this embodiment of the present invention includes an upper or elevation housing portion 3 (FIG. 1*c*) that is rotatably mounted to a lower or azimuth housing portion 5. In the position of FIG. 1*c*, the planar section 7 of the upper housing portion 3 is oriented substantially horizontally. In doing so and as explained in more detail below, the antenna element within the upper housing 3 (e.g., a dish-shaped reflector) is pointed upwardly at substantially 90 degrees to the horizontal. As indicated above, the upper housing portion 3 is rotatably mounted to the lower housing portion 5 and can be rotated about the axis 2 to the other extreme position of the series of views of FIG. 2*a*-2*d*. In the position of FIG. 2*c*, the planar section 7 of the upper housing portion 3 in this embodiment is nearly vertical with the antenna element in it pointing nearly horizontally. The further series of views of FIG. 3*a*-3*e* then show the upper housing portion 3 rotated relative to the lower housing portion 5 to a position between the extremes of FIGS. 1*a*-ad and 2*a*-2*d*.

Figure 4:
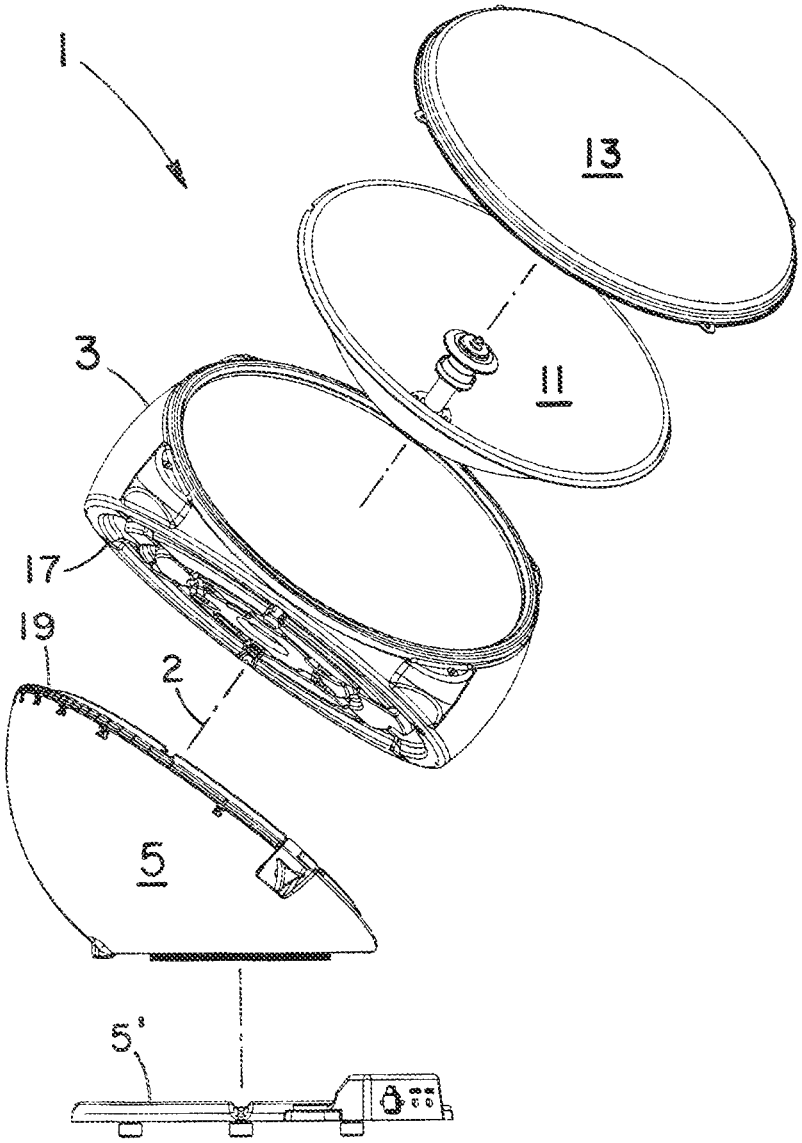
FIG. 4 is an exploded, perspective view of the upper and lower housing portions of the enclosure system and the satellite dish antenna arrangement positioned within the upper or elevation housing portion.
Figure 5:
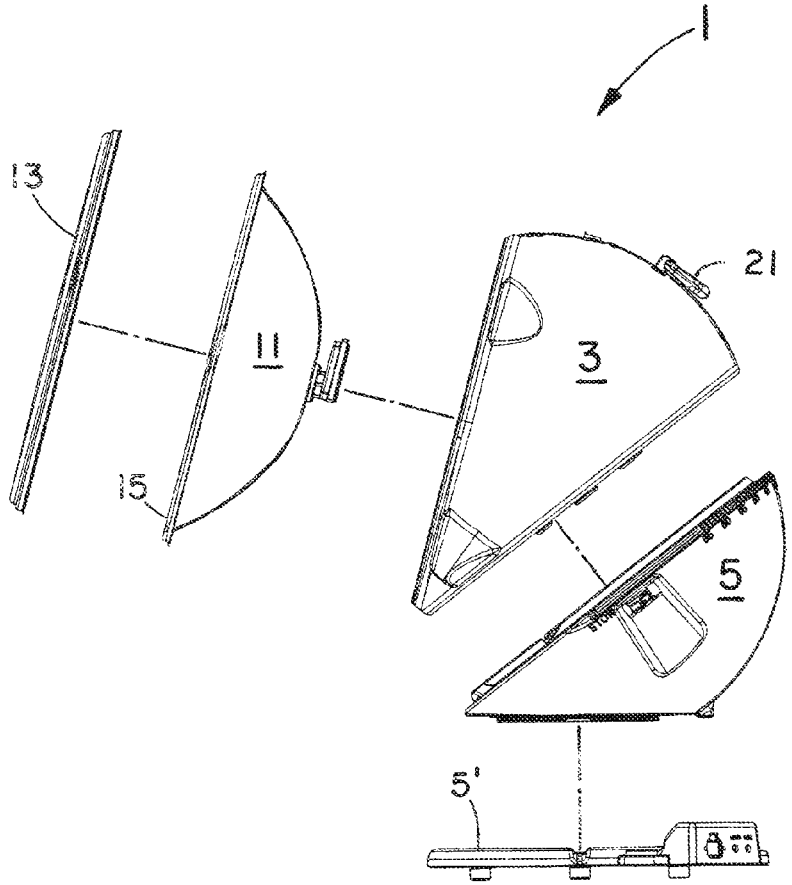
FIG. 5 is an exploded, side view of the enclosure system and antenna of FIG. 4.
Figure 6:
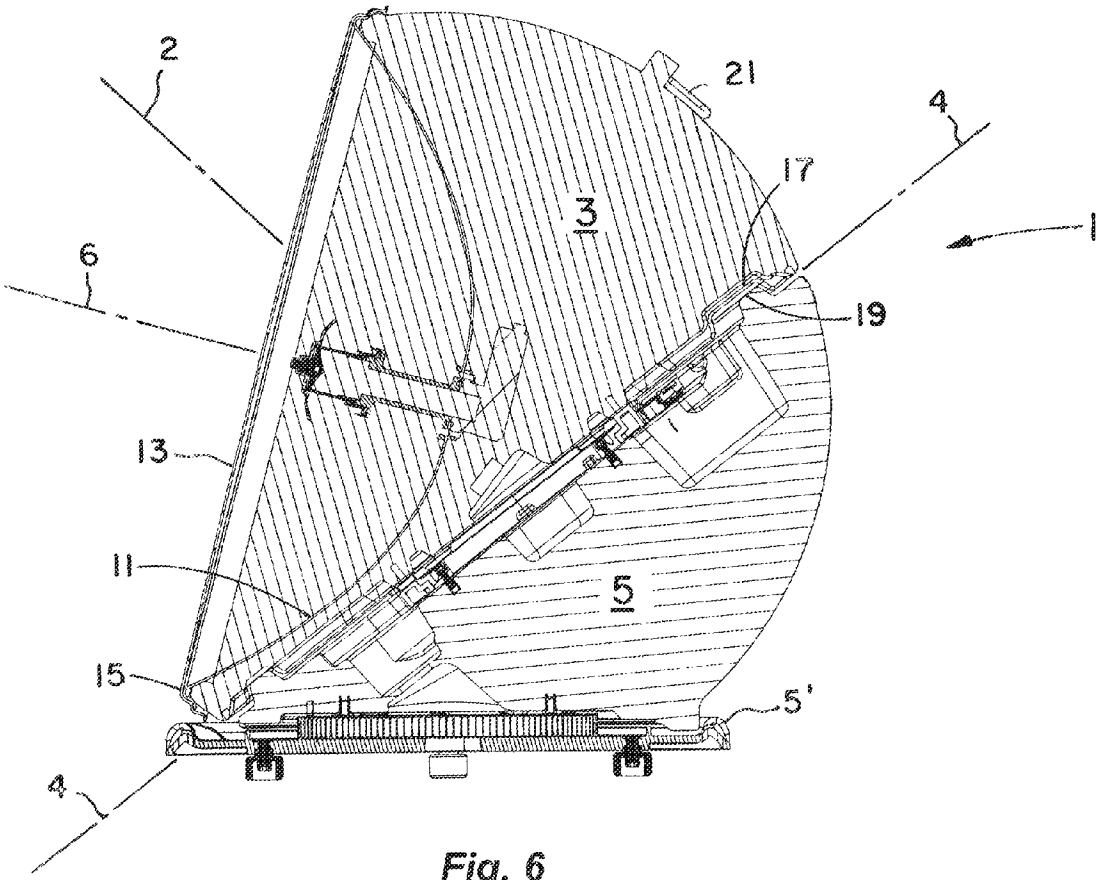
FIG. 6 is a cross-sectional view of the enclosure system in use with a satellite dish antenna arrangement.

The enclosure system 1 of the present invention can be used with any number of antenna elements including the satellite antenna arrangement with the dish-shaped reflector 11 shown in FIGS. 4-6. With such an arrangement, the dish-shaped reflector 11 is preferably mounted within the upper housing portion 3 and protected and enclosed by a cover 13. The cover 13 is made of a radio frequency (RF) permeable material and in contrast with typical radome designs, only the cover 13 of the present invention needs be made of such relatively expensive RF permeable material versus the entire dome in a typical radome design. That is, the dish-shaped reflector 11 in the embodiment of FIGS. 1-6 is fixed to the upper housing portion 3 and moves with it. Consequently, only the cover 13 needs to be made of RF permeable material at great cost savings over a normal radome design in which the entire dome needs to be made of such material because the dish-shaped reflector in typical radome designs moves within and relative to the stationary dome. In addition to such cost savings, the present design offers the user the option of making the cover 13 out of more expensive and superior RF permeable material at less than or at least no additional, overall cost beyond a typical radome design made entirely of an inferior RF permeable material. That is, the cover 13 can be made of the more expensive, better performing material and the rest of the housing of a much cheaper material or materials for special applications such as ultraviolet or heat resistance. This is the case because the dish-shaped reflector 11 of the present invention only receives signals through the cover 13 and no other part of the protective housing in contrast to a typical radome design. The result can be not only a better performing antenna but also a less expensive one.

The dish-shaped reflector 11 is preferably covered at 13 in FIGS. 1*a*-6 but can be uncovered if desired. Regardless, an advantage of the present design is that the dish-shaped reflector 11 can be easily skewed manually in comparison to a typical radome design. This is the case whether or not a protective cover 13 is provided over or across the rim portion 15 of the reflector 11. That is, common radome designs require that the entire dome be removed to manually skew the antenna whereas the design of the present invention only requires that the protective cover 13 be removed (if one is used). Otherwise, the antenna can be manually skewed directly if no protective cover 13 is provided. The same is true for making other, common adjustments.

Figure 7A:
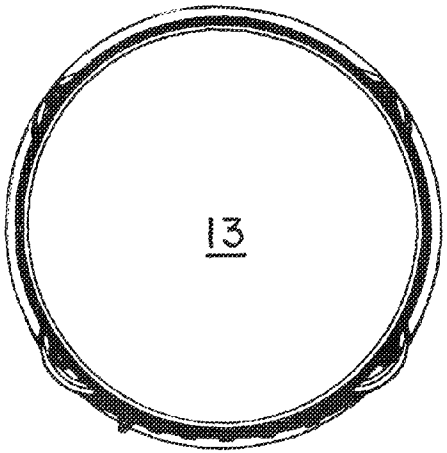
FIGS. 7*a*-7*c* are a series of views of the enclosure system in its stowed position of FIG. 1*a*-1*d*.
Figure 7B:
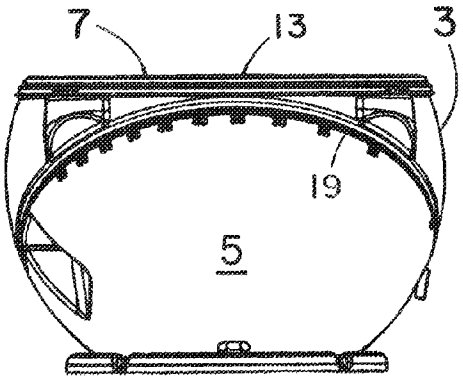
Figure 7C:
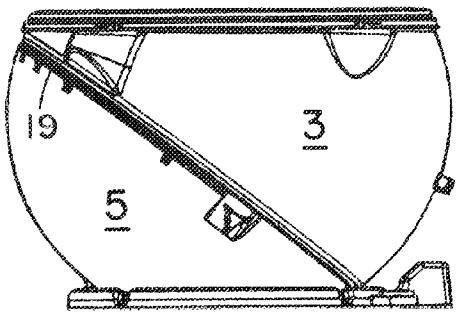

A major advantage of the present invention in this embodiment as best seen in FIG. 7*b* is that it can assume a stowed position with the planar section 7 of the upper housing portion 3 extending substantially horizontally. In doing so, the minimum height of the upper housing portion 3 (e.g., 15 inches) is then less than the diameter of this planar section 7 (e.g., 19 inches) and less than the diameter (e.g., 18 inches) of the dish-shaped reflector 11 of FIG. 6. That is, the protective housing or enclosure can assume a storage position that is shorter than the maximum height (i.e., diameter) of the antenna element (be it a dish-shaped reflector such as 11 or other antenna). This is the case whether or not a cover 13 is provided and whether or not the dish-shaped reflector 11 is flush with the planar section 7 or slightly recessed below it. Consequently, for any desired storage height, a larger antenna can be used than in a typical radome design in which the storage height is as high or higher than the maximum dimension of the antenna. Being able to use a larger antenna (e.g., larger diameter reflector) can then offer a higher gain for better reception. The present design also allows for a large, interior space or volume for more electronics and devices (e.g., rotors, amplifiers, wireless transmitters, motors, and additional antennas) if desired. The preferred embodiment can be used as a standalone, portable unit weighing about 16-20 pounds and provided with a convenient, carrying handle 21 (FIGS. 5 and 6).

In operation, it is seen in FIGS. 1-3 that with a satellite dish antenna or other antenna, the enclosure system 1 of this embodiment of the present invention includes at least the upper and lower housing portions 3,5 that are mounted to each other for rotational movement about a first axis 2 inclined to the vertical. As shown in FIGS. 4-6, the upper and lower housing portions 3,5 of this embodiment have respective, substantially circular peripheral sections 17,19 extending about the first axis 2 (FIG. 6) and abutting one another in the assembled position of FIGS. 1*a*-3*e* and 6. The sections 17,19 extend substantially parallel to each other and to a plane 4 (FIG. 6) that is substantially perpendicular to the inclined, first axis 2. With the illustrated embodiments having a satellite antenna arrangement, the dish-shaped reflector 11 is mounted to the upper housing portion 3 to extend substantially about a second axis 6 (FIG. 6) that substantially intersects the first axis 2 at an inclined angle. The dish-shaped reflector 11 has a substantially circular rim portion 15 (FIGS. 4-6) extending about the second axis 6 (FIG. 6) substantially in a plane that is essentially perpendicular to the second axis 6.

Figure 8A:
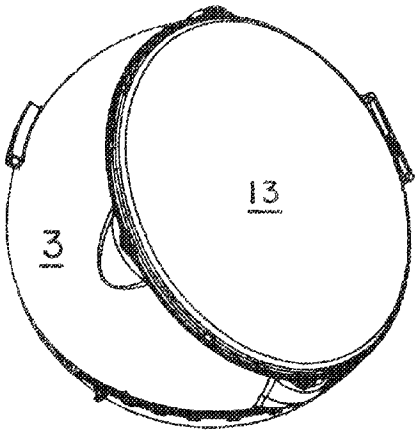
FIGS. 8*a*-8*c* are a series of further views of the enclosure system at an elevation of 45 degrees as in FIG. 3*a*-3*e*.
Figure 8B:
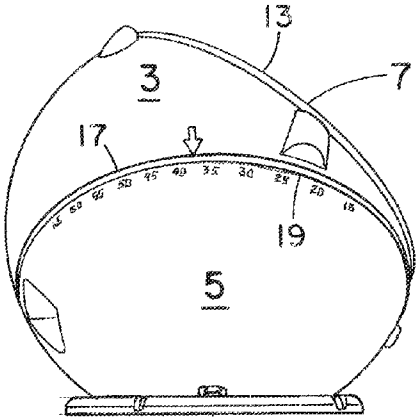
Figure 8C:
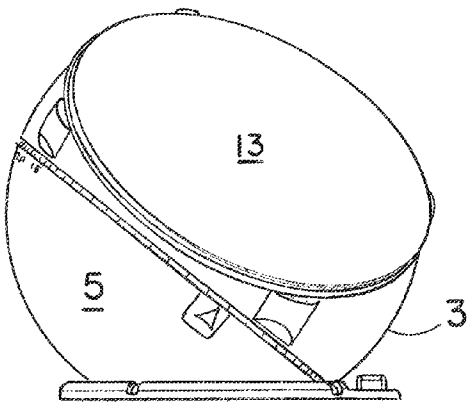

In this embodiment, the upper housing portion 3 can be rotated about the inclined, first axis 2 relative to the lower housing portion 5 wherein the second axis 6 essentially forms or defines a cone about the first axis 2. In doing so, the plane of the rim portion 15 of the dish-shaped reflector 11 in FIG. 6 like the planar section 7 of the upper housing portion 3 in FIGS. 1-3 can be positioned as desired in any of a plurality of orientations essentially between a substantially horizontal one and a substantially vertical one. In particular and with the first axis 2 inclined at 45 degrees to the vertical in this embodiment, the plane of the rim portion 15 of the dish-shaped reflector 11 can be moved to either a horizontal or vertical orientation and any orientation therebetween. In a design chosen for reception in the United States, the first axis 2 could be customized to be inclined at 37.5 degrees to the vertical wherein the plane of the rim portion 15 of the dish-shaped reflector 11 is then movable from the extremes of horizontal and 15 degrees elevation and any orientations in between. In particular and as used herein, any reference to the plane of the rim portion 15 of the dish-shaped reflector 11 or any other plane such as the planar section 7 of the upper housing 3 as being positionable substantially or nearly vertically is meant to include such a customized variation. The lower housing portion 5 and its supporting base 5' in FIGS. 4-6 could also be marked for proper azimuth orientation during installation or motorized if desired. Similarly, the adjacent, peripheral sections 17,19 of the upper and lower housings could be so marked as illustrated in FIGS. 7*b* and 8*b* for proper elevation orientation.

In the embodiments for a satellite dish antenna, the dish-shaped reflector 11 can be recessed into the housing and covered or not covered as discussed above. It could also be fixed to the outside of the housing if desired and the same is true for other antenna elements such as single frequency, narrowband, and broadband ones. That is, the basic design of the housing can be used as an adjustable mount with the antenna either mounted inside the housing or to its exterior. The basic design of the housing also permits it to be mounted on sloped surfaces such as a roof with the inclined angle of the upper and lower housing portions modified accordingly or an additional, tilt adjustment member could be provided. Further, in instances where height is not critical, the housing can be made more aerodynamic by capping the reflector with an arched cover. This would give the housing an overall spherical or other aesthetic and aerodynamic shape more suitable for marine and vehicle tracking applications.

Figure 9:
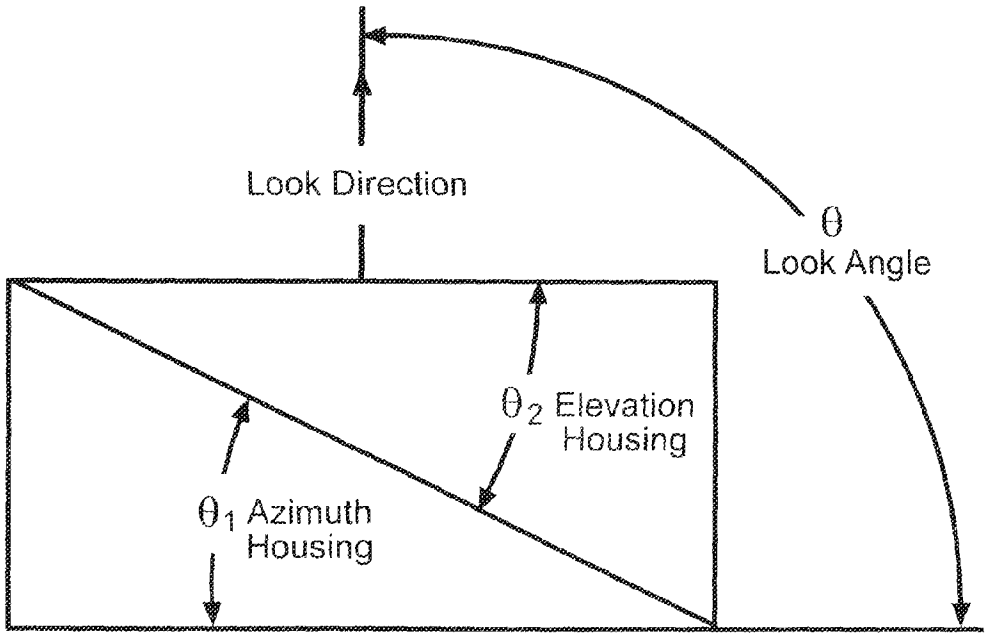
FIGS. 9 and 10 show mathematical representations of the various angles and look directions the basic enclosure system of the present invention can be built to accommodate.
Figure 10:
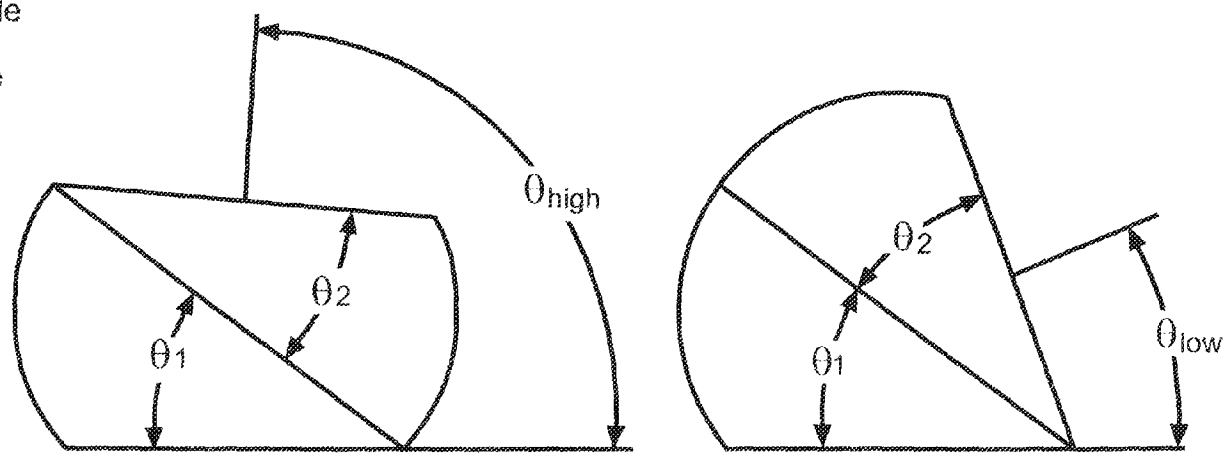

Although specific examples of various angles including 37.5 and 45 degrees have been shown and described in detail, FIGS. 9 and 10 includes mathematical representations of the wider range of angles and look directions the basic enclosure system 1 of the present invention could be built to accommodate. As for example, the abutting sections 17 and 19 of the earlier illustrations were shown in simplified versions as being substantially complements of one another. However, they could be of widely varying and different sizes, shapes, and angles per the mathematical representations of FIGS. 9 and 10. The angle of the lower or bottom housing portion in FIGS. 9 and 10 could be 45 degrees for example and the angle of the upper or top housing portion 15 degrees for example to then direct the upward look angle at 15 degrees to the horizontal. Consistent with the mathematical representations, nearly any angle combinations can be created as desired for any particular application. Also, the basic enclosure system 1 as noted has been illustrated in simplified versions with at least upper and lower housing portions but could have any number of portions consistent with the ability of the present invention to be able to assume a wide variety of orientations of the antenna within the mathematical representations of FIGS. 9 and 10. It is also noted that the antenna of the present invention could be a receiving and/or transmitting one.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

We claim:

1. An enclosure system for a satellite antenna arrangement having a dish-shaped reflector, said enclosure system having at least upper and lower housing portions, said upper housing portion being mounted to the lower housing portion for rotational movement relative to the lower housing portion about a first axis inclined to the vertical, said upper and lower housing portions having respective sections extending substantially about said first axis and substantially abutting one another about the first axis in an operating position, said abutting sections in said operating position extending substantially parallel to a common plane, said dish-shaped reflector of said satellite antenna arrangement being mounted to said upper housing portion to extend substantially about a second axis substantially intersecting said first axis at an inclined angle, said dish-shaped reflector having a substantially circular rim section extending substantially about the second axis substantially in a plane substantially perpendicular to said second axis, said upper housing portion being rotatable about the first axis relative to the lower housing portion wherein said second axis substantially forms a cone about the first axis to selectively position the plane of the rim portion of the dish-shaped reflector in a plurality of orientations.

2. The enclosure system of claim 1 wherein said upper housing portion includes a cover of radio frequency permeable material extending over the rim portion of the dish-shaped reflector to enclose the dish-shaped reflector within the upper housing portion.

3. The enclosure system of claim 2 wherein the cover is made of a different material than the remainder of the upper housing.

4. The enclosure system of claim 3 wherein the radio frequency permeability of the material of the cover is substantially higher than the material of the remainder of the upper housing portion.

5. The enclosure system of claim 4 wherein the radio frequency permeability of the material of the cover is substantially higher than the material of the lower housing portion.

6. The enclosure system of claim 1 wherein said substantially circular, rim portion of the dish-shaped reflector has a diameter and the minimum vertical height of the upper housing portion with said plane in a substantially horizontal orientation is less than said diameter.

7. The enclosure system of claim 1 wherein said dish-shaped reflector is mounted to said upper housing portion in a fixed position relative thereto.

8. The enclosure system of claim 1 wherein the abutting sections of the upper and lower housing portions are substantially circular about the first axis and extend substantially at the same distance from the first axis wherein the plane of the rim portion of the dish-shaped reflector is selectively positionable between a substantially horizontal position and a substantially vertical position.

9. The enclosure system of claim 8 wherein said substantially circular, rim portion of the dish-shaped reflector has a diameter and the minimum vertical height of the upper housing portion with said plane in said substantially horizontal position is less than said diameter.

10. An enclosure system for an antenna, said enclosure system having at least upper and lower housing portions with the upper housing portion being mounted to the lower housing portion for rotational movement relative thereto about a first axis inclined to the vertical, said upper and lower housing portions having respective sections extending substantially about the first axis and substantially abutting one another about the first axis in an operating position, said sections in said operating position extending substantially parallel to a common, first plane, said antenna being mounted to said upper housing portion to move therewith wherein the upper housing portion can be rotated about said first axis to substantially form a cone with a second axis substantially intersecting and inclined to said first axis to selectively position a second plane substantially perpendicular to said second axis in a plurality of orientations.

11. The enclosure system of claim 10 wherein the antenna includes a dish-shaped reflector having a substantially circular rim portion extending about said second axis substantially in said second plane perpendicular to said second axis wherein the rim portion of said dish-shaped reflector can be selectively positioned in a plurality of orientations.

12. The enclosure system of claim 11 further including a cover of radio frequency permeable material extending over the rim portion of the dish-shaped reflector to enclose the dish-shaped reflector within the upper housing portion.

13. The enclosure system of claim 12 wherein the cover is made of a different material than the remainder of the upper housing.

14. The enclosure system of claim 13 wherein the radio frequency permeability of the material of the cover is substantially higher than the material of the remainder of the upper housing portion.

15. The enclosure system of claim 13 wherein the radio frequency permeability of the material of the cover is substantially higher than the material of the lower housing portion.

16. The enclosure system of claim 10 wherein the abutting sections of the upper and lower housing portions are substantially circular about the first axis and extend substantially at the same distance from the first axis wherein the second plane is selectively positionable between a substantially horizontal position and a substantially vertical position.

17. The enclosure system of claim 10 wherein said dish-shaped reflector is mounted to said upper housing portion in a fixed position relative thereto.

18. The enclosure system of claim 10 wherein the antenna includes a dish-shaped reflector with a substantially circular rim portion extending about the second axis in said second plane and the abutting sections of the upper and lower housing portions are substantially circular about the first axis and extend substantially at the same distance from the first axis wherein the second plane of the rim portion of the dish-shaped reflector is selectively positionable between a substantially horizontal position and a substantially vertical position.

19. The enclosure system of claim 18 wherein said substantially circular rim portion of the dish-shaped reflector has a diameter and the minimum vertical height of the upper housing portion with said second plane in said substantially horizontal position is less than said diameter.

20. The enclosure system of claim 10 wherein said second plane defines a circular plane within said cone having a first diameter and the minimum vertical height of the upper housing portion with said second plane in a substantially horizontal orientation is less than said diameter.

21. The enclosure system of claim 10 wherein the antenna extends substantially in said second plane perpendicular to said second axis.

22. The enclosure system of claim 10 wherein said antenna is at least one of a single frequency, narrowband frequency, and broadband frequency antenna.

23. The enclosure system of claim 10 wherein said antenna is at least one of a receiving and transmitting antenna.

24. The enclosure system of claim 10 wherein said antenna is both a receiving and transmitting antenna.

* * * * *